US006622733B2

(12) United States Patent
Saksa

(10) Patent No.: US 6,622,733 B2
(45) Date of Patent: Sep. 23, 2003

(54) COSMETIC APPLICATOR

(75) Inventor: Thomas A. Saksa, Albany, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 122 days.

(21) Appl. No.: 10/016,559

(22) Filed: Oct. 22, 2001

(65) Prior Publication Data

US 2003/0075195 A1 Apr. 24, 2003

(51) Int. Cl.[7] ..... A45D 24/00
(52) U.S. Cl. ..... 132/200
(58) Field of Search ..... 132/200, 218, 132/317, 318; 239/3, 690, 324, 332; 424/47

(56) References Cited

U.S. PATENT DOCUMENTS 5,501,535 A * 3/1996 Hastings et al. ..... 400/88
5,868,322 A 2/1999 Loucks, Jr. et al.
5,884,846 A 3/1999 Tan
5,961,050 A 10/1999 Kitajima
6,032,876 A 3/2000 Bertsch et al.
6,068,198 A 5/2000 Gupta
6,138,687 A 10/2000 Sheffler et al.
6,192,890 B1 2/2001 Levy et al.
6,252,129 B1 * 6/2001 Coffee ..... 602/42

OTHER PUBLICATIONS

U.S. patent application Ser. No. 2003/0041871 A1 Endo et al, Makeup mirror apparatus and makeup method using the same, Mar. 2003.*
U.S. patent application Ser. No. 2002/0155069 A1 Pruche et al, Cosmetic treatment and device, Oct. 2002.*

* cited by examiner

*Primary Examiner*—John J. Wilson
*Assistant Examiner*—Robyn Kieu Doan

(57) ABSTRACT

An applicator for use in applying cosmetics. The applicator includes a body having at least one reservoir configured to contain cosmetics and an ejection head having a plurality of nozzles in fluid communication with the cosmetics. The applicator further includes a control circuit operably coupled with the ejection head to control ejection of cosmetics from the plurality of nozzles onto an application surface.

20 Claims, 3 Drawing Sheets

COSMETIC APPLICATOR

FIELD OF THE INVENTION

The present invention relates generally to cosmetics, and more particularly, to a cosmetic applicator using printer technology.

BACKGROUND

Cosmetics and body paints have been used for centuries. Typically, such cosmetics are applied to the face and body to enhance one's beauty or alter one's natural state. Cosmetics are generally applied using various shaped applicators, such as brushes or pads. These applicators are often only suitable for one type of application. Thus, multiple applicators may be needed to apply different types and colors of makeup to one's face. These multiple applicators are necessary because it is often difficult to achieve an even blending of colors using a single applicator, and it may be difficult to create fine lines with a broad-brush applicator.

Today's applicators have a relatively short useful life. Furthermore, since the applicators are generally removable from the cosmetic, it is not unusual for one to lose the applicator or the make-up and have to replace one or the other. Additionally, the quality of the applicator typically deteriorates with use. For example, brushes may become clumped with old make-up, or pads may become saturated with make-up, making it difficult to control the precise amount of make-up being applied. Also, once an applicator has been used for a blend of colors, it may be difficult to subsequently use the applicator for a single color.

Another problem with today's make-up applicators is the potential for contamination. Since a make-up applicator typically contacts the user's skin, bacteria, debris and other contaminates may be carried from the skin to the applicator. The contaminated applicator may then be re-used, contaminating the makeup source and/or a second user. Additionally, contamination of the applicator may cause unwanted blending of multiple cosmetics.

SUMMARY OF THE INVENTION

The present invention is directed to an applicator for use in applying cosmetics. The applicator includes a body having a reservoir configured to contain cosmetics, and an ejection head having a plurality of nozzles in fluid communication with the cosmetics contained within the reservoir. The applicator further includes a control circuit operably coupled with the ejection head to control ejection of cosmetics from the plurality of nozzles onto an application surface.

DETAILED DESCRIPTION OF THE INVENTION

The present invention provides a device and method for applying cosmetics to an application surface. The device includes an applicator capable of using inkjet technology to eject cosmetic ink onto an application surface. Application surface, as used herein, includes one's skin, hair, nails, etc and other suitable body parts. For example, the applicator may be used to apply cosmetics to one's face, including the eyes, cheeks, mouth, etc.

Figure 1:
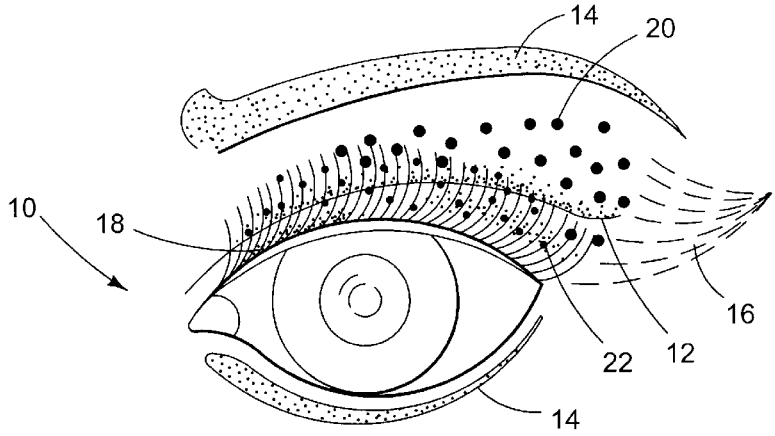
FIG. 1 depicts a simplified representation of an eye showing various make-up patterns that may be applied using a cosmetic applicator constructed in accordance with one embodiment of the present invention.

As illustrated in FIG. 1, and generally indicated at 10, the applicator may be used to highlight and beautify one's eyes. A single applicator may generate multiple patterns. For example and discussed in more detail below, the applicator may be used to create fine lines at 12, broad diffuse lines at 14, feathered areas at 16, areas of light color at 18, areas of dark color at 20, blended regions at 22, etc.

The applicator also may be used to apply cosmetics to an application surface in the form of temporary tattoos or as conventional face and body paint. Thus, the applicator may be used to form multiple designs, which may take virtually any form, including animal pictures, team symbols, company logos, and/or other suitable shapes. Depending on the features incorporated in the applicator, the design may incorporate any number of a plurality of colors or blends of colors. The designs may be drawn freehand with the applicator or may be applied using a stencil or other suitable outline to aid in producing the desired design.

Figure 2:
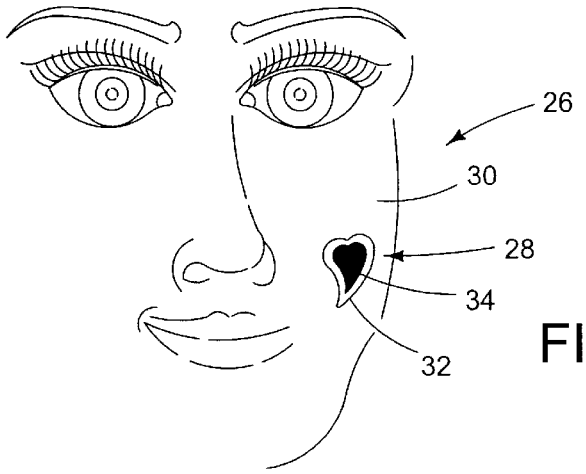
FIG. 2 depicts a representation of a face-painting, which may be applied using a cosmetic applicator constructed in accordance with one embodiment of the present invention.

Thus, as generally indicated at 26 in FIG. 2, the applicator may be used to apply a picture to one's face. In the exemplary illustration, a heart 28 has been applied to a child's cheek 30. Although a desired design may require the use of different colors and different line configurations, a single applicator may be used to create the design. Thus, a single applicator may be used to both outline the heart, at 32, and to color the heart at 34 even where the color of the heart is different than the color of the outline of the heart.

Cosmetics, as used herein, refer to preparations of cosmetic inks that may be applied to enhance the beauty of skin, lips, eyes, hair, nails, etc. Cosmetics, as used herein, also include topical preparations used for medicinal purposes, including all ink preparations and topical preparations that are non-toxic and safe to apply to one's skin. The cosmetic inks may be water-soluble such that they may be easily removed using conventional soap and water. Alternatively, the cosmetic inks used in the present applicator may be more permanent such as to form temporary tattoos or more permanent make-up. The cosmetics used in the applicator must meet requirements of the ink delivery system (described below). Thus, the cosmetics typically will be a low viscosity ink. The cosmetics may be dye-based or pigment based. Additionally, the cosmetics used in the applicator may be fluid cosmetics, wax-based cosmetics or solid cosmetics.

Figure 3:
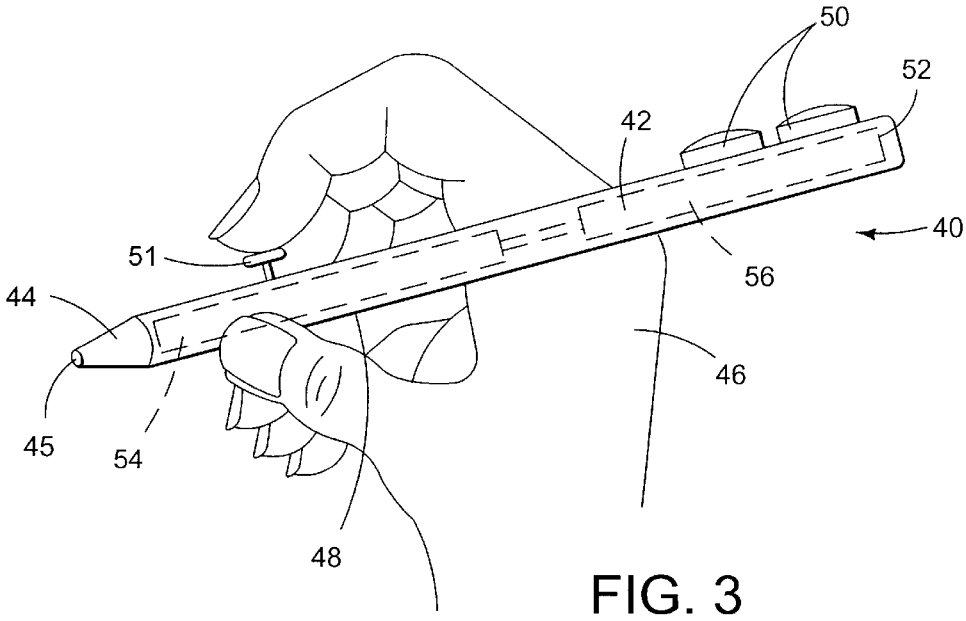
FIG. 3 depicts a cosmetic applicator constructed in accordance with one embodiment of the present invention.

An applicator constructed according to one embodiment of the present invention is shown generally in FIG. 3 at 40. Applicator 40 typically includes a body 42 and an applicator tip 44. In the present illustration, applicator 40 is shown in the shape of a stylus that may be held in a user's hand 46. The applicator also may be sized such that it approximately corresponds to the size of a writing pen. Such a configuration may be easy for a user to manipulate and for the user to transport. For example, a pen-sized applicator may conveniently fit within one's handbag or purse. Alternatively, applicator 40 may take any other suitable hand-held shape.

Body 42 also may include a gripping surface 48 that facilitates the handling of applicator 40. For example, gripping surface 48 may aid a user in holding applicator 40 steady when using the applicator. Gripping surface 48 may be made of a plastic or other suitable material.

Body 42 includes an ink delivery system, generally indicated at 52 in FIG. 3. Ink delivery system 52 delivers cosmetics contained within body 42 to applicator tip 44. The cosmetics are contained within an ink reservoir (schematically illustrated at 54 in FIG. 3) within body 42. Ink reservoir or container 54 is fluidly linked to an ink-ejection head 45 (also referred to as a printhead) contained within applicator tip 44. Ink-ejection head 45 includes a plurality of nozzles, which are in fluid communication with the cosmetics in ink reservoir 54. The ink reservoirs are positioned within body 42 such that cosmetics may be delivered to ink-injection head 45 under direction of a control circuit (schematically illustrated at 56 in FIG. 3). Control circuit 56 is operably coupled with ink-ejection head 45 and controls expulsion of cosmetics from the nozzles in ink-ejection head 45 onto an application surface.

Figure 4:
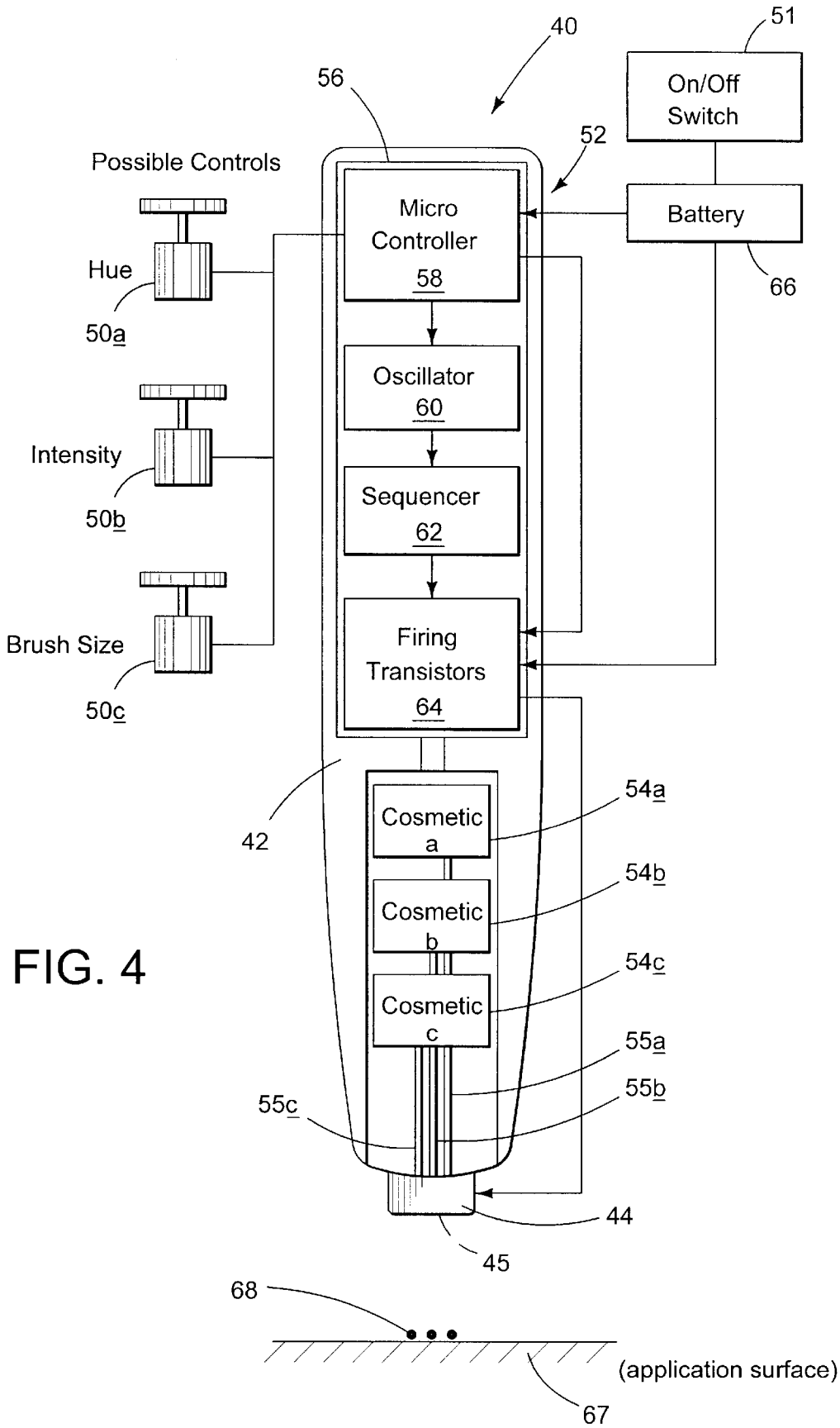
FIG. 4 is a block diagram showing the control system of the cosmetic applicator of FIG. 3.

Body 42 may include multiple ink reservoirs. Each reservoir may contain a different type and/or color cosmetics. Each reservoir is linked directly to ink-ejection head 45. For example, FIG. 4 illustrates an applicator having three ink reservoirs 54*a*, 54*b*, 54*c*, which are all fluidly connected to tip 44 of applicator 40. Conduits or cosmetic channels 55*a*, 55*b*, 55*c* may provide pathways which link the corresponding ink reservoirs 54*a*, 54*b*, 54*c* with ink-ejection head 45. The cosmetics then may be expelled from the applicator via a plurality of nozzles in ink-ejection head 45.

In the embodiment depicted in FIG. 4, applicator 40 is depicted having three ink reservoirs, each with a different type of cosmetic. These different types of cosmetics are typically different color cosmetics. Thus, a first reservoir may contain yellow cosmetics (cosmetic a), a second reservoir may contain magenta cosmetics (cosmetic b), and a third reservoir may contain cyan cosmetics (cosmetic c). Designated nozzles are fluidicly coupled to corresponding reservoirs. By controlling release of cosmetics from these nozzles (such as by controlling the frequency of firing of particular nozzles), the cosmetics released from the nozzles may be mixed creating additional blended colors.

Applicator 40 may be configured such that after multiple uses, the applicator is disposable. Alternatively, applicator 40 may be configured such that the ink reservoirs themselves may be replaced, thereby, increasing the life of the applicator. Additionally, ink reservoirs 54*a*, 54*b*, 54*c* may be replaceable such that a user may be able to substitute new colors or different types of cosmetics into the applicator.

FIG. 4 shows a block diagram of a typical ink delivery system 52. Control circuit 56, as briefly described above, controls ejection of cosmetics from the applicator. The control circuit is operably coupled with user-selectable switches such that the user may control the application of cosmetics by changing the appearance characteristics of the cosmetic swath. As illustrated, control circuit 56 may include a microcontroller 58, an oscillator 60, a sequencer 62, and firing transistors 64. More particularly, firing transistors 64 cause nozzles in the ink-ejection head to fire and expel cosmetics onto an application surface. Oscillator 60 controls the firing rate of the firing transistors by sending electrical pulses to the firing transistors. The firing rate may be limited by the architecture of the ink-ejection head. As shown, control circuit 56 may also include a sequencer 62. Sequencer 62 may be used to control the particular sequence of nozzles fired. Although not illustrated, some embodiments may have a control circuit which includes only a battery, an oscillator and firing transistors. The oscillator may be preset to provide the optimal firing of the nozzles.

The oscillator 60, sequencer 62 and firing transistors 64 may be individually linked with a user-selectable controls 50*a*, 50*b*, 50*c*. Each of the controls, or regulating switches, regulates the flow of cosmetics from the applicator such that a user may select the desired printing effect. The controls may take the form of dials, toggle switches, levers, knobs, buttons, etc. Individual switches may control the hue 50*a*, intensity 50*b*, size of cosmetic ink swath or brush size 50*c* or any other appearance characteristic of the applied makeup. Each switch may be moveable between a range of positions corresponding to changes in hue/color, intensity, and or swath size by altering the cosmetic ejection pattern from the applicator.

Thus, a user may be able to control the intensity of the cosmetic swath by changing the firing rate of the nozzles. The firing rate may be increased by increasing the pulses sent via oscillator 60 to firing transistors 64. The intensity of the cosmetic swath may also be affected changing the sequence of the nozzles as directed by sequencer 62. For example, the intensity of a cosmetic swath may be decreased (as shown at 18 in FIG. 1) by dropping nozzles out of the sequence or decreasing the firing rate. The intensity (at 20 in FIG. 1) may be increased by adding additional nozzles or increasing the firing rate. Similarly, the number of nozzles that are directed to fire by the firing transistors also may contribute to the cosmetic swath size as applied to an application surface. Thus, fine lines (at 12 in FIG. 1) may be produced by firing less nozzles, while broad lines (at 14 in FIG. 1) may be produced by firing more nozzles.

Control circuit 56 may also include a microcontroller 58. Microcontroller 58 may be directly linked to user selectable controls 50*a*, 50*b*, and 50*c*. The controls may be potentiometers and/or selection menus depending on the complexity of the microcontroller. Microcontroller 58 receives a user's input and directs oscillator 60, sequencer 62 and firing transistors 64 to fire the appropriate nozzles at a particular rate and sequence to create the desired pattern. Accordingly, when a user selects the hue, intensity and size of the desired swath, the microcontroller directs the oscillator, the sequencer, and the firing transistors to eject cosmetics appropriately. Thus, as described above, the microcontroller may control the release of cosmetics from particular nozzles effecting a change in the size of the cosmetic swath, and/or effecting the intensity by controlling the firing rate and sequence of firing. Hue effects may also be controlled by microcontroller 58. Thus, where there are multiple ink reservoirs having different colored cosmetics, particular nozzles are linked to each of the reservoirs. By directing the firing transistors to fire only certain nozzles, different colors can be produced. Additionally, depending on the complexity of microcontroller 58 and its software, microcontroller 58 may be used to draw shapes or other complex patterns.

Applicator 40 may also include a trigger or on/off switch 51 that is manipulable by a user to control application of cosmetics to the application surface. Such a trigger switch supplies power to a power supply 66. Power supply 66 may provide power to microcontroller 58 and firing transistors 64. The power supply may be an on-board battery such that the applicator is a self-contained unit. Alternatively, a battery pack or remote power supply may be attached to the applicator to provide power to the microcontroller.

In operation, a user sets the appropriate controls (50*a,* 50*b,* 50*c*) to define the desired cosmetic appearance characteristics. The microcontroller then directs the appropriate release of cosmetics from the applicator. Droplets of cosmetics 68 are expelled from the ink-ejection head or printhead 45 toward application surface 67.

Figure 5:
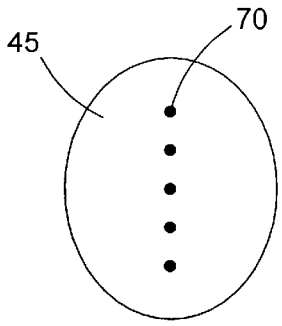
FIG. 5 is an enlarged bottom view of an exemplary arrangement of nozzles for an ink-ejection head of the cosmetic applicator shown in FIG. 3.
Figure 6:
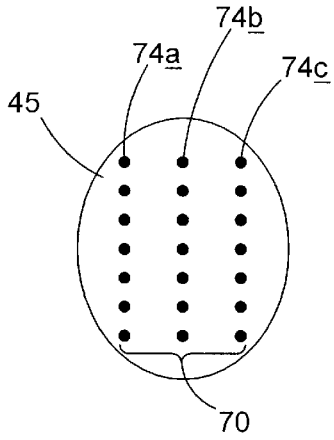
FIG. 6 is an enlarged bottom view of an ink-ejection head employing a first alternative nozzle pattern.
Figure 7:
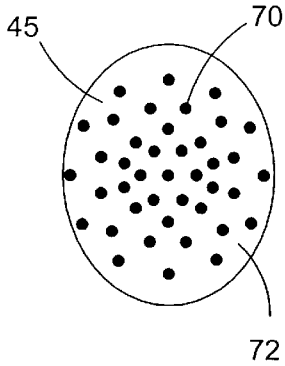
FIG. 7 is an enlarged bottom view of an ink-ejection head, employing a second alternative nozzle pattern.

As discussed above, the tip of the applicator includes an ink-ejection head 45 having a plurality of nozzles or orifices. Cosmetic droplets are ejected through these small nozzles toward the application surface or skin. FIGS. 5–7 illustrate three different nozzle patterns for ink-ejection head 45 of cosmetic applicator 40. Although only three patterns are illustrated, any suitable arrangement of nozzles may be used.

For example, as shown in FIG. 5, nozzles 70 may be in a single column configuration on the bottom of printhead 45. A single color may be used in such an arrangement. Changing the sequence and timing of the firing of the nozzles may change the intensity and/or brush size of the cosmetic ink swath.

In another embodiment, as shown in FIG. 6, there may be a multiple nozzles 70 arranged in columns or rows 74. Each column 74*a,* 74*b,* 74*c* may be connected to a different ink reservoir such that each column (and each nozzle in the column) ejects a single color. Thus, there may be separate nozzles for each color. Accordingly, different colors may be printed depending on which nozzles are being fired. By firing adjacent nozzles, it may be possible to mix colors to create additional colors or hues.

A third configuration is shown in FIG. 7 where the nozzles 70 are arranged in concentric circles or showerhead configuration 72. With such a configuration as shown in FIG. 7, the number of nozzles 70 on printhead 45 may be increased providing a user with more precise controls when applying cosmetics.

A user may also control the appearance of cosmetics expelled from the applicator by controlling the position of the applicator relative to the application surface. The closer the applicator is held to a surface the larger the cosmetic drop may appear. If the applicator is held further away from the application surface, than the cosmetic application may be more diffuse, thereby creating finer lines.

Figure 8:
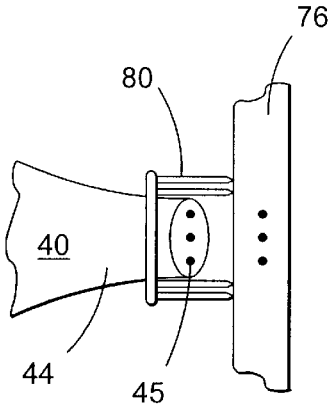
FIG. 8 is an enlarged side view of an applicator tip fitted with a brush extension.
Figure 9:
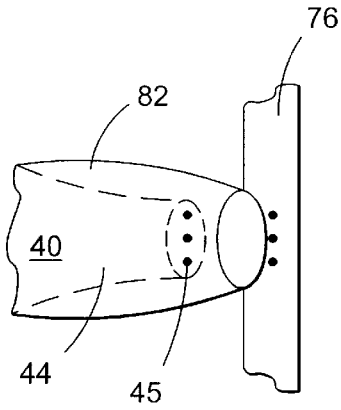
FIG. 9 is an enlarged side view of an applicator tip having a recessed ink-ejection head.
Figure 10:
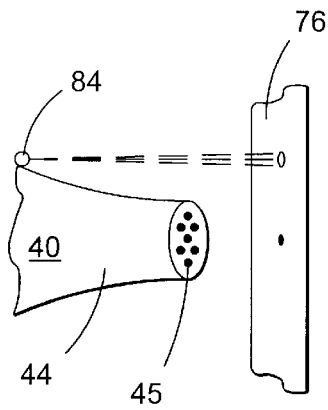
FIG. 10 is an enlarged side view of another applicator tip having a guide light for use in directing a user in controlling distance between the application and the user's skin.

Referring to FIGS. 8–10, three alternative applicator tip configurations are shown, each being configured to assist a user in controlling the distance applicator 40 is held from an application surface 76 during application of a cosmetic. In FIG. 8, a brush extension 80 is shown extending from applicator tip 44 of applicator 40. The brush spaces the nozzles of printhead 45 from the application surface 76. The user may then be able to control the distance of the nozzles from the face by the pressure felt by the brush against his/her skin. Such a tactile experience permits a user to hold the applicator steady when applying cosmetics.

As shown, brush extension 80 extends from the upper and lower surface of printhead 45 such that printhead 45 is interposed between brush extension 80. Alternatively, brush extension 80 may extend all the way around applicator tip 44 or extend on only a single side of applicator tip 44. The length of the bristles of brush extension 80 may depend on the optimal distance that an applicator should be held from a surface. The bristles of brush extension 80 also may be used to feather or texture cosmetics ejected from applicator 44, thus creating a different cosmetic application effect.

In FIG. 9, applicator tip 44 is characterized by a recessed ink-ejection head 45. An external tip 82 of applicator 40 extends beyond ink-ejection head 45 preventing the nozzles contained in the ink-ejection head from contacting application surface 76. Such a configuration prevents contamination of printhead 45 by contaminants, including bacteria, debris, make-up, etc. The tip is shown in a stationary position which may position printhead 45 an optimal distance from application surface 76 such that cosmetics may be consistently applied to any number of application surfaces. Alternatively, an adjuster may be used such that a user can position applicator tip 44 in any number of positions inside external tip 82. Such an adjuster permits a user to alter the distance of printhead 45 from application surface 76.

Another alternative embodiment is shown in FIG. 10 where applicator 40 includes a guide light 84, which shines on application surface 76. Guide light 84 projects a representative light beam toward application surface 76 to indicate the appearance of cosmetics applied from the applicator from that distance. The size of the light beam which hits the application surface may correspond to the size of the cosmetic ink swath formed when the applicator is held at a particular distance from the application surface. Thus, a user may control the size of the cosmetic swath by adjusting the applicator to the appropriate distance as exemplified by the light. As described above, the ability of the user to not have the nozzles directly contact the skin or application surface avoids potential contamination of the tip of the applicator.

While the present invention has been particularly shown and described with reference to the foregoing preferred embodiments, those skilled in the art will understand that many variations may be made therein without departing from the spirit and scope of the invention as defined in the following claims. The description of the invention should be understood to include all novel and non-obvious combinations of elements described herein, and claims may be presented in this or a later application to any novel and non-obvious combination of these elements. The foregoing embodiments are illustrative, and no single feature or element is essential to all possible combinations that may be claimed in this or a later application. Where the claims recite "a" or "a first" element or the equivalent thereof, such claims should be understood to include incorporation of one or more such elements, neither requiring nor excluding two or more such elements.

I claim:

1. An applicator for use in applying one or more cosmetics, the applicator comprising:

a body having a first reservoir configured to contain a cosmetic;

an ejection head having a plurality of nozzles in fluid communication with the cosmetic;

a second reservoir with a color cosmetic in fluid communication with a subset of the plurality of nozzles; and a control circuit operably coupled with the ejection head to control ejection of cosmetics from the plurality of nozzles onto an application surface.

2. The applicator of claim 1, further comprising a user-selectable intensity control configured to control the ejection of cosmetic by altering at least one of the frequency and sequence at which the plurality of nozzles eject cosmetic.

3. The applicator of claim 1, further comprising a user-selectable brush-size control configured to control the ejection of cosmetic by altering which of the plurality of nozzles ejects cosmetic.

4. The applicator of claim 1, further comprising a user-selectable hue control configured to control the ejection of cosmetic from the subset of the plurality of nozzles to generate a desired color.

5. The applicator of claim 1, wherein the applicator is a self-contained unit.

6. The applicator of claim 1, wherein the plurality of nozzles are arranged in a column.

7. The applicator of claim 6, wherein the applicator is configured to eject a single cosmetic from the plurality of nozzles.

8. The applicator of claim 1, wherein the plurality of nozzles are arranged in a plurality of columns.

9. The applicator of claim 8, wherein each column is configured to eject a different cosmetic.

10. The applicator of claim 9, wherein the different cosmetic includes different colored cosmetics.

11. The applicator of claim 1, wherein the plurality of nozzles are arranged in concentric circles.

12. The applicator of claim 1, wherein the body is pen-shaped.

13. The applicator of claim 1, further comprising a trigger switch for selectively providing power to the control circuit.

14. An applicator for applying cosmetics on a user, the applicator comprising:

a body having a first reservoir and a second reservoir each reservoir configured to contain a different color cosmetic;

a delivery system coupled with the body and configured to independently control ejection of cosmetics from the first and second reservoir; and an ejection head coupled to the body having a plurality of nozzles wherein nozzles in a first subset are fluidly linked to the first reservoir and nozzles in a second subset are fluidly linked to a second reservoir;

wherein the body includes an applicator tip having a guide light configured to project a light representative of the height of cosmetics applied via the applicator when the applicator is held at a distance from an application surface.

15. The applicator of claim 14, further comprising a user-selectable hue control configured to independently control the ejection of cosmetics from the first and second subset of nozzles to generate a desired color.

16. The applicator of claim 14, wherein the body includes an applicator tip having a brush extension.

17. The applicator of claim 14, wherein the body includes an external tip configured to extend beyond the ejection head such that the ejection head is maintained away from an application surface.

18. A hand-held applicator configured to apply cosmetics to an application surface, the applicator comprising:

a body configured to be gripped by a user, the body having a first reservoir and a second reservoir;

an ejection head having a first set of nozzles in fluid communication with the first reservoir and a second set of nozzles in fluid communication with the second reservoir;

a delivery system including firing transistors configured to independently fire the nozzles in both the first and second set of nozzles; and a plurality of user-selectable controls configured to permit a user to regulate the firing frequency and sequence of the firing transistors to regulate expulsion of cosmetics from the first and second set of nozzles.

19. The applicator of claim 18, wherein the delivery system is configured to release cosmetics from both the first and second reservoirs from the first and second set of nozzles such that the cosmetics from the two reservoirs is blended.

20. A method of applying cosmetics, the method comprising:

providing a cosmetic applicator, wherein the applicator includes an ink reservoir configured to contain cosmetics, an ejection head having a plurality of nozzles in fluid communication with the cosmetics; and a control circuit operably coupled with the ejection head to control expulsion of cosmetics from the plurality of nozzles;

selecting a subset of the plurality of nozzles via a first user-selectable control operably linked to the control circuit;

selecting a frequency at which to fire the subset of nozzles;

selecting a sequence for firing the subset of nozzles; and independently controlling and firing the subset of nozzles at the selected frequency and sequence such that cosmetics are ejected onto a user's body.

* * * * *